United States Patent [19]

Hough

[11] 4,108,351

[45] Aug. 22, 1978

[54] ADHERING METHOD

[75] Inventor: Edmund Alan Hough, Wavre, Belgium

[73] Assignee: Imperial Chemical Industries Limited, London, England

[21] Appl. No.: 682,790

[22] Filed: May 3, 1976

[30] Foreign Application Priority Data

May 8, 1975 [GB] United Kingdom ..... 19380/75

[51] Int. Cl.[2] ..... B65D 33/20

[52] U.S. Cl. ..... 229/62; 150/7; 156/309; 206/813; 428/40; 428/88

[58] Field of Search ..... 229/62, 80; 150/7; 206/813; 428/40, 88; 156/309

[56] References Cited

U.S. PATENT DOCUMENTS

| | | | |
|---|---|---|---|
| 2,030,135 | 2/1936 | Carpenter | 206/813 X |
| 3,010,859 | 11/1961 | Stephens et al. | 428/40 |
| 3,014,829 | 12/1961 | Curtin | 428/40 X |
| 3,348,762 | 10/1967 | Kasinkas | 229/80 |
| 3,502,207 | 3/1970 | Alexander | 428/40 |
| 3,906,128 | 9/1975 | Burling et al. | 428/86 |

*Primary Examiner*—Stephen P. Garbe

*Attorney, Agent, or Firm*—Cushman, Darby & Cushman

[57] ABSTRACT

A releasable resealable seal is formed between two surfaces by providing one surface with a pile which is bonded to that surface, providing the other surface with a layer of tack adhesive and pressing the surfaces together.

4 Claims, 4 Drawing Figures

ADHERING METHOD

Figure 1:
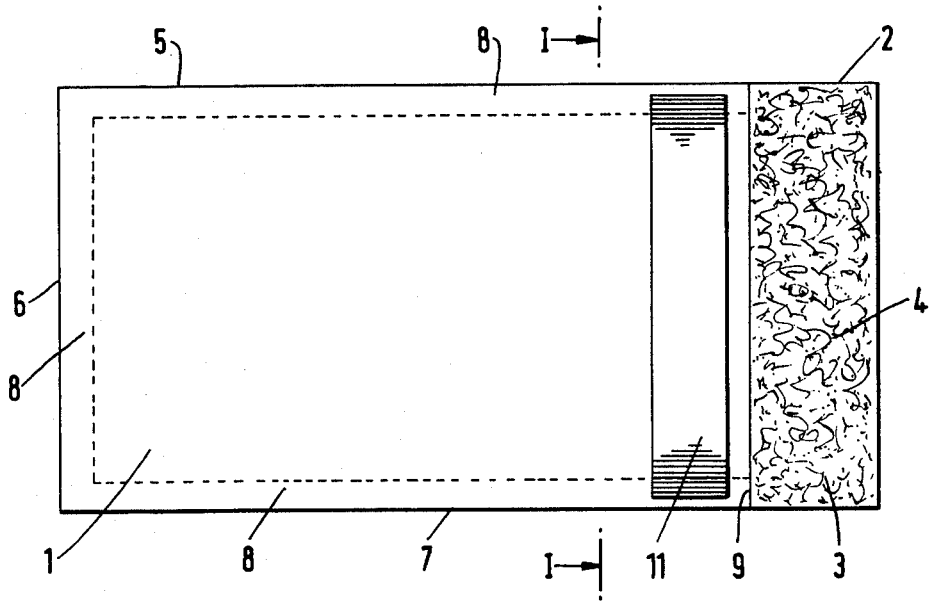

The present invention relates to a method of adhesion and articles using said method.

Envelopes of the self-seal type generally comprise a closure flap coated on its back with an adhesive layer which mates with an adhesive layer provided on a co-operating surface of the envelope. Usually the closure flap is an extension of the front sheet of the envelope and the co-operating surface is the back sheet of the envelope. Whilst these envelopes can be opened by peeling the co-operating surface and surface coated with adhesive apart, resealing by merely pressing these surfaces together again is generally unsatisfactory because during opening, the adhesive is at least partially removed from the closure flap and/or the co-operating surface.

It has now been found that an envelope may be more reliably sealed and resealed after opening along the seal if one surface is provided with a pile of fibres or fibrils and the other surface is coated with a tack adhesive.

According to the present invention an envelope of the self-seal type is provided which comprises a closure flap and a cooperating surface against which the closure flap may adhere to seal the envelope, one from the closure flap and the cooperating surface having a pile of fibres or fibrils and the other having a layer of a tack-adhesive, mating of which provides the envelope seal.

The envelope may have a strip of pile of fibres or fibrils on the closure flap or the cooperating surface, but it is preferred that either the front or back sheet, most preferably both sheets, have internal faces covered with a pile of fibres or fibrils. Such preferred envelopes have the advantages of improved thermal or shock insulation for the contents of the envelope. Where the internal faces of one or both sheets are covered with a pile of fibres or fibrils, an extension of one sheet may serve as the closure flap of the present envelope.

A pile from any suitable pile surfaced material may be used herein although we find it most convenient to use a pile surfaced material produced from a thermoplastic material according to the techniques described in British patent application Nos. 1378638, 1378639 and 1378640. In the techniques of these patents a laminar pile surfaced material is formed by feeding a thermoplastic material and a backing to a heated surface with the thermoplastic material between the backing and the heated surface so that the thermoplastic softens and bonds to the backing as well as adhering to the heated surface so that the combination of the thermoplastic and the backing may be peeled away from the heated surface so that the thermoplastic is drawn into fibrils of fibres to provide a pile surface.

In the envelopes of the present invention the fibres or fibrils preferably have a length between 1mm and 10m, most preferably between 2mm and 6mm.

Preferred fibril forming thermoplastic materials which may be employed in the production of a pile surfaced product for use according to the present invention include addition polymers, for example polymers and copolymers of ethylene, propylene, butadiene, vinyl chloride, vinyl acetate, vinylidene chloride, acrylonitrile and styrene and condensation polymers, for example polyamides and polyesters, e.g. of glycols and aromatic dicarboxylic acids. Blends of filament forming polymeric materials may also be used.

As examples of specific thermoplastic polymeric materials that may be employed we may mention polyethylene, polypropylene, nylon, polyethylene terephthalate and polyvinyl chloride. Particularly preferred polymeric material is low density polyethylene.

The backing may be of any suitable material as described in the above patent specifications but preferably the backing is of paper, which may be newsprint, light or heavy duty wrapping paper, kraft paper, or flexible cardboard.

In making the present envelopes, a strip of pile surface product may be secured onto a closure flap or co-operating surface of a preformed envelope or envelope blank before assembly but preferably the whole sheet which forms the side containing the closure flap is fabricated from a pile surfaced product.

Envelopes having on one or more internal surfaces a pile surface are described in British patent specification No. 1393091 the disclosure of which is incorporated herein by way of reference.

The adhesive used in the envelopes of the present invention is a tack-adhesive. Such adhesives adhere well to dry objects merely by pressing the object onto the adhesive. For the present envelopes, the adhesive may be for example spread directly onto the cooperating surface or a tape having both sides coated with tack-adhesive may be stuck to the cooperating surface. In order to reduce the risk of the tack adhesive becoming contaminated or adhering to other objects before the envelope is used, it is desirable to cover the tack-adhesive with a release paper or the like which can be removed from the adhesive paper immediately before the envelope is sealed.

Hence in accordance with the present invention, a method for releasably adhering a pile surfaced material to a substrate is provided which comprises contacting the pile of said material onto a layer of tack adhesive which has been applied to a surface of the substrate.

Whilst the broad aspect of the invention has hitherto been described with particular reference to envelopes, it will be readily understood that the pile surfaced material may be made to adhere releasably to any substrate to which a tack adhesive can adhere. Such a substrate may be rigid or flexible and the pile surfaced product may have for example a woven or non-woven backing or those hereinbefore described or those described in British patent specification No. 1334672.

Pile-surfaced products have a variety of uses where releasable adhesion is an asset. For example the products can be used as dust mats on floors and as dusters. The method of the present invention is useful in such applications where a layer of tack adhesive is applied to the floor or head of a duster apparatus and an area of the product can be turned or folded over for adherence to the tack adhesive whilst leaving the remainder of the product as a dust mat or duster. In another embodiment, the product can have a pile surface on both surfaces whereby one surface is for adhesion and the other serves as dust mat or duster.

Figure 2:
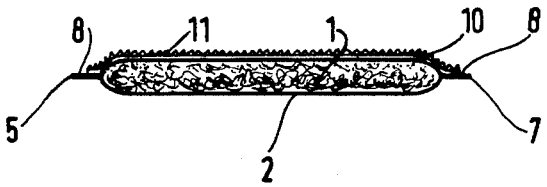
Figure 3:
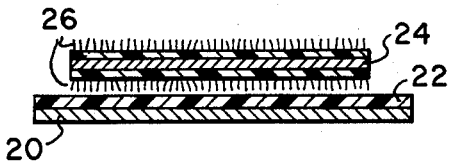
Figure 4:
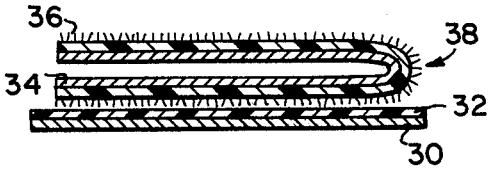

One preferred embondiment of the invention is illustrated with reference to the accompanying Figures of which FIG. 1 is a plan view of an envelope, FIG. 2 is a section on the line I—I of FIG. 1, FIG. 3 is a cross-section of a second embodiment of the invention, and FIG. 4 is a cross-section of a third embodiment.

The envelope comprises an upper sheet 1 and lower sheet 2. Both sheets were formed from material having a piled surface 3. The sheets have the same width but lower sheet 2 is longer, the extra length forming closure flap 4. In forming the envelope, edges 5,6,7, are superimposed and heated to form a heat seal 8. The upper sheet has free unsealed leading edge 9. A piece of double sided self-adhesive tape 10 is placed on the upper sheet 1 at the cooperating portion, and a release paper 11 is located on the upper and exposed surface of the adhesive tape.

In order to seal the envelope, the release paper was removed and the closure flap folded about leading edge 9 so that the pile on the closure flap meets with and adheres to the exposed surface of adhesive tape 10. A firm seal was formed on pressing together the closure flap and adhesive tape on the cooperating surface. The flap and cooperating surface were peeled apart and resealed six times, each seal being strong, without substantial breaking of the of the pile from the closure flap.

FIG. 3 illustrates an embodiment of the invention wherein a laminar material having a pile surface on both sides is releasably adhered to a substrate 20 by means of a layer of tack adhesive 22 applied to the latter. The laminar material comprises a backing 24 having a pile 26 on its upper and lower surfaces.

FIG. 4 illustrates an embodiment wherein a laminar material having a pile on one side is releasably adhered by that side to a substrate 30 by means of a layer of tack adhesive 32 applied to the latter. The laminar material comprises a backing 34 having a pile 36 on one side, the material being folded over at 38.

The pile-surfaced material was prepared as follows:

A sheet of brown wrapping paper, 90 $gm^{-2}$, was fed into a Kodak 15 TC glazing machine with a hot roll at 150° C and a layer of polyethylene film (2 plies each 50 $\mu m$ thick) was fed at the same rate between the paper and the hot roll. The contact time of the paper and film on the hot roll was approximately 30 seconds and during this time the paper and film were held in contact with the hot roll by pressure applied to an endless belt of resilient material. The paper sheet was parted from the hot roll and a blast of air directed at the side of the sheet nearest to the hot roll. The product was a sheet of paper having firmly bonded to it a soft pile of polyethylene fibrils approximately 5 mm long.

I claim:

1. An envelope of the self-seal type comprising first and second overlying sheets of flexible material, the opposed surfaces of said sheets having bonded thereto a thermoplastic pile so that the internal surfaces of the envelope are pile surfaced, the other surfaces of said sheets being free of pile, said first sheet being of greater length than said second sheet so as to form a closure flap which can be folded into engagement with a cooperating portion of said other surface of said second sheet, and a layer tack adhesive on said cooperating portion.

2. A method for releasably adhering a pile surfaced laminar material to a substrate, said pile surface material having a pile on both surfaces and having been formed by feeding a thermoplastic material and a backing to a heated surface with the thermoplastic material between the backing and the heated surface so that the thermoplastic material softens and bonds to the backing and adheres to the heated surface and then peeling the combination of the thermoplastic and the backing away from the heated surface thereby drawing the thermoplastic into fibrils or fibres to provide a pile surface, said method comprising contacting the pile on one surface of said material onto a layer of tack adhesive which has been applied to a surface of the substrate and leaving the other surface of said material exposed.

3. A method for releasably adhering a pile surfaced laminar material to a substrate, said pile surfaced material having been formed by feeding a thermoplastic material and a backing to a heated surface with the thermoplastic material between the backing and the heated surface so that the thermoplastic material softens and bonds to the backing and adheres to the heated surface and then peeling the combination of the thermoplastic and the backing away from the heated surface thereby drawing the thermoplastic into fibrils or fibres to provide a pile surface, said method comprising turning or folding over an area of said material and contacting the pile of said material onto a layer of tack adhesive which has been applied to a surface of the substrate, while leaving the remainder of said material exposed.

4. A method for releasably adhering a pile surfaced laminar material to a substrate, said pile surfaced material having been formed by feeding a thermoplastic material and a backing to a heated surface with the thermoplastic material between the backing and the heated surface so that the thermoplastic material softens and bonds to the backing and adheres to the heated surface and then peeling the combination of the thermoplastic and the backing away from the heated surface thereby drawing the thermoplastic into fibrils or fibres to provide a pile surface, said method comprising contacting the pile of said material onto a layer of tack adhesive which has been applied to one side of a tape, said tape also having a layer of tack adhesive on its other side, said other side being adhered thereby to said substrate.

* * * * *